US006848668B2

(12) United States Patent
Figueiredo et al.

(10) Patent No.: US 6,848,668 B2
(45) Date of Patent: Feb. 1, 2005

(54) SILENT-OPERATING DEVICE FOR FEEDING WATER INTO A TANK, IN PARTICULAR FOR FILLING A LAVATORY FLUSH TANK

(75) Inventors: Noé Figueiredo, Aveiro (PT); Antonio Manuel Gameiro Lopes, Assafarge-Coimbra (PT); Victor Antonio Ferreira Da Costa, Aveiro (PT); Antonio Manuel Moura De Oliveira, Aveiro (PT)

(73) Assignee: Oliveira & Irmao S.A., Aveiro (PT)

( * ) Notice: Subject to any disclaimer, the term of this patent is extended or adjusted under 35 U.S.C. 154(b) by 29 days.

(21) Appl. No.: 10/321,435

(22) Filed: Dec. 18, 2002

(65) Prior Publication Data

US 2003/0192594 A1 Oct. 16, 2003

(30) Foreign Application Priority Data

Dec. 28, 2001 (IT) ..... MI2001A 002831

(51) Int. Cl.[7] ..... E03D 9/14; F16L 55/02

(52) U.S. Cl. ..... 251/127; 181/234

(58) Field of Search ..... 137/625.3; 251/118–127; 181/233–234

(56) References Cited

U.S. PATENT DOCUMENTS

| | | | | |
|---|---|---|---|---|
| 1,229,434 A | | 6/1917 | Flockhart | |
| 1,383,886 A | | 7/1921 | Webb | |
| 1,697,481 A | | 1/1929 | Sloan | |
| 1,976,442 A | | 10/1934 | Finn | |
| 4,125,129 A | * | 11/1978 | Baumann | 137/625.3 |
| 4,407,327 A | * | 10/1983 | Hanson et al. | 137/625.3 |
| 6,026,859 A | * | 2/2000 | Wears et al. | 137/625.33 |

OTHER PUBLICATIONS

European Search Report of Nov. 11, 2003.

* cited by examiner

*Primary Examiner*—Paul J. Hirsch
(74) *Attorney, Agent, or Firm*—Harness, Dickey & Pierce, P.L.C.

(57) ABSTRACT

There is provided a silent-operating device for feeding water into a tank, in particular for filling a lavatory flush tank; the silencing effect is achieved by feeding the water through a chamber housing flow deflecting members; the members are perforated members arranged successively and spaced apart in the flow direction inside the chamber, and have respective numbers of through holes; the holes of consecutive members being offset with respect to one another to define a labyrinth path, i.e. a number of winding coil-like or zigzag paths, inside the chamber.

21 Claims, 2 Drawing Sheets

SILENT-OPERATING DEVICE FOR FEEDING WATER INTO A TANK, IN PARTICULAR FOR FILLING A LAVATORY FLUSH TANK

The present invention relates to a silent-operating device for feeding water into a tank, in particular for filling a lavatory flush tank.

BACKGROUND OF THE INVENTION

As is known, filling a lavatory flush tank after each flushing operation generates sound vibration which is preferably eliminated or at least reduced.

Various types of flush tank feed devices designed to reduce noise are known.

For example, European Patent Application EP-A-424274 provides for reducing noise by circulating the water in a chamber filled with solid spheroidal bodies. Though fairly effective, this solution still leaves room for further improvement in terms of noise reduction, besides posing manufacturing problems (mainly owing to the necessity of producing and inserting the solid bodies into the chamber).

SUMMARY OF THE INVENTION

It is an object of the present invention to provide a water feed device which, as compared with known solutions, is fully effective in reducing noise, and at the same time is cheap and easy to produce.

According to the present invention, there is provided a silent-operating device for feeding water into a tank, in particular for filling a lavatory flush tank, comprising a chamber for the passage of a flow of water; said chamber housing flow deflecting members, and comprising an inlet and an outlet defining a flow direction; and the device being characterized in that said members are perforated members arranged successively and spaced apart substantially in said flow direction.

In addition to being cheap and easy to produce, tests have shown the device according to the present invention to be also fully effective in terms of noise reduction.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
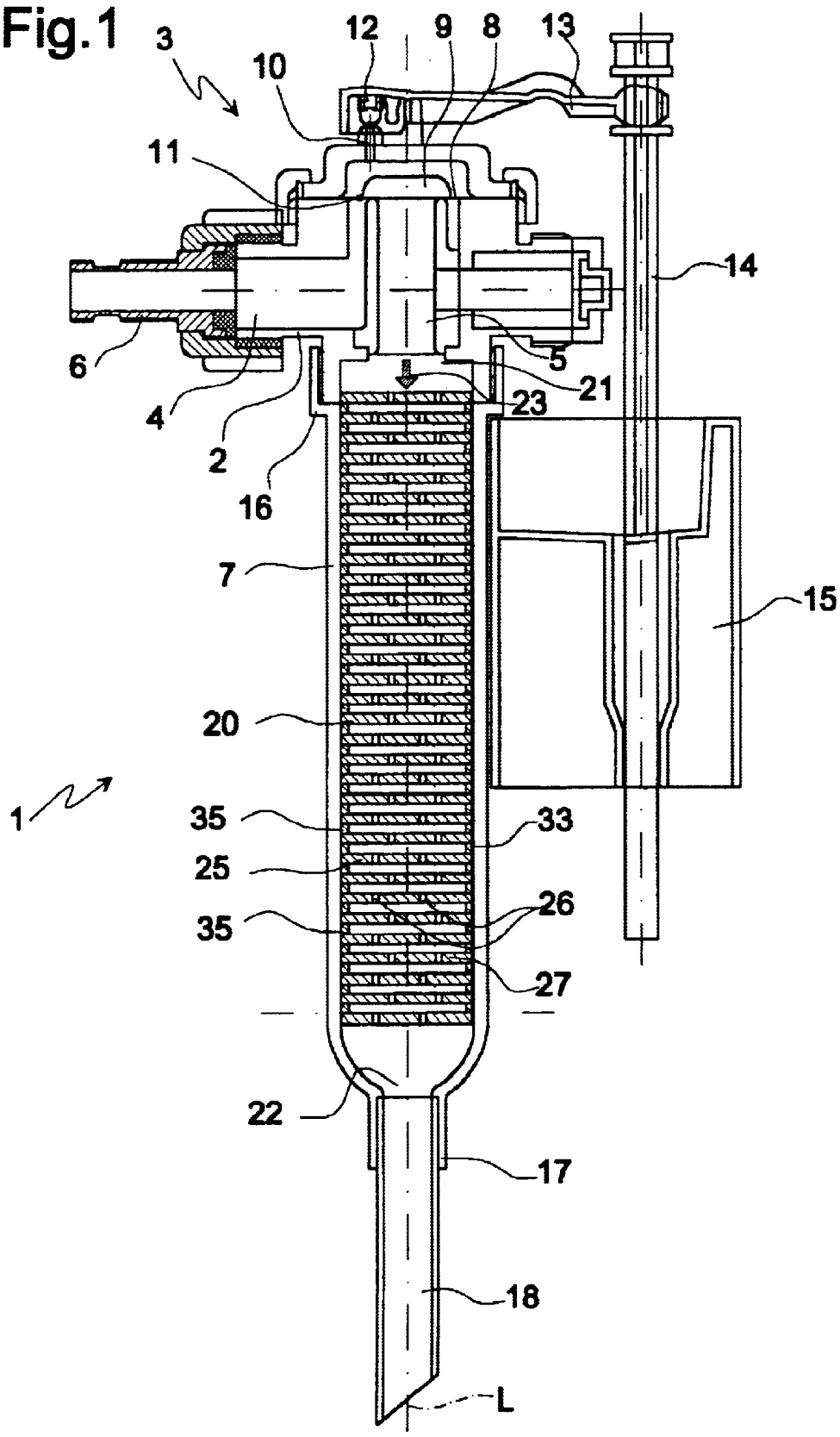
FIG. 1 shows a longitudinal section of a feed device in accordance with the invention.

Number 1 in FIG. 1 indicates as a whole a silent-operating feed device for a flush tank (not shown). Device 1 comprises a body 2 housing a valve assembly 3 interposed between an inlet channel 4 and an outlet channel 5. Inlet channel 4 is connected to a fitting 6 for connection to the water mains, and outlet channel 5 is connected to an outflow pipe 7 having an axis substantially perpendicular to inlet channel 4 and, in use, substantially vertical.

In the non-limiting example shown in FIG. 1, valve assembly 3 is a known diaphragm valve assembly, and therefore not described or illustrated in detail. Briefly, valve assembly 3 comprises a disk-shaped diaphragm 8 separating inlet channel 4 from outlet channel 5 and closing a counterpressure chamber 9; counterpressure chamber 9 has a relief hole 10, and communicates with inlet channel 4 via a small-section nozzle 11 through diaphragm 8; a shutter 12, controlled by a lever 13 connected to a float 15 by an adjustable rod 14, selectively opens and closes relief hole 10; and diaphragm 8 is elastically deformable to allow water to flow from inlet channel 4 to outlet channel 5 when relief hole 10 is open.

Outflow pipe 7 has an end 16 for connection to body 2 (and having, for example, a threaded coupling and sealing rings); and a free end 17 opposite end 16 and possibly connected to a tubular extension 18.

Outflow pipe 7 is provided internally with a chamber 20 for passage of the flow of water from outlet channel 5. Chamber 20, which for example is cylindrical, comprises an inlet 21 and an outlet 22 located respectively at ends 16 and 17 of outflow pipe 7, and defining a water flow direction indicated schematically in FIG. 1 by arrow 23 and coincident, in the example shown, with a longitudinal axis L of chamber 20.

Chamber 20 houses a number of perforated flow deflecting members 25 comprising respective numbers of through holes 26, and which are positioned transversely inside chamber 20, and are arranged successively and spaced apart substantially in the water flow direction 23 inside chamber 20, i.e. along axis L.

Figure 2:
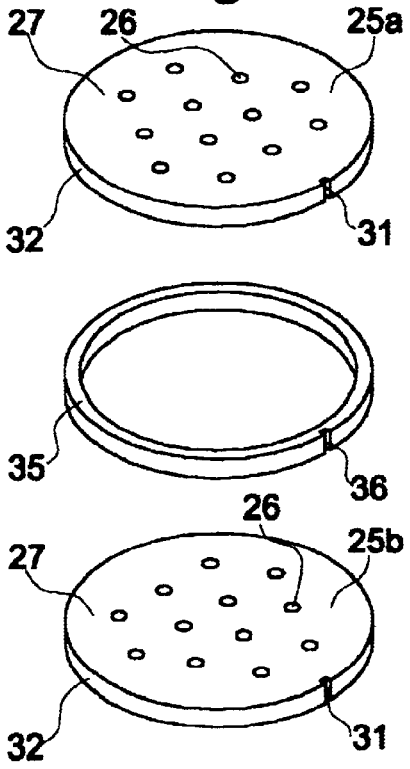
FIG. 2 shows an exploded view in perspective of a number of component parts of the FIG. 1 device.
Figure 3:
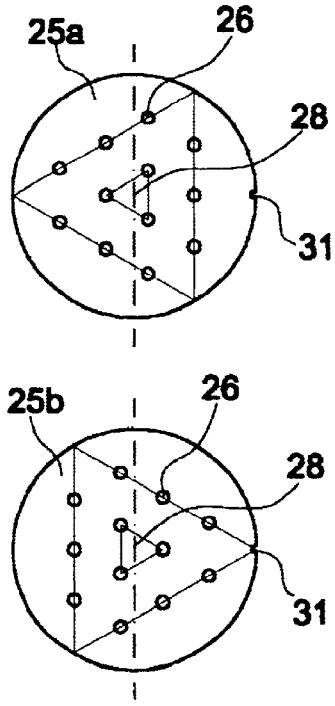
FIG. 3 shows a plan view of two of the component parts in FIG. 2.

With reference also to FIGS. 2 and 3, each member 25 comprises a flat perforated plate 27 positioned substantially perpendicular to axis L and in the form of a circular disk with a diameter substantially equal to the inside diameter of chamber 20. Holes 26 are substantially parallel to axis L, and the holes 26 of consecutive members 25 (e.g. members 25*a*, 25*b* in FIGS. 2 and 3) are offset to define, inside chamber 20, a labyrinth water flow path comprising a large number of winding coil-like or zigzag water flow paths.

The shape, size, and arrangement of holes 26 may obviously be varied in numerous ways, while still defining a labyrinth water flow path. More specifically, a winding coil-like or zigzag path may also be obtained using members 25, each with only one hole 26, providing the holes 26 of consecutive members 25 are offset. What is shown and described herein is therefore to be considered purely as a non-limiting example.

In the embodiment shown purely by way of a non-limiting example, each member 25 has a number of holes 26 spaced in the form of a triangle and symmetric with respect to a geometric centre 28 of member 25. Consecutive members 25*a*, 25*b* have the same arrangement of respective holes 26, but are turned 180° with respect to each other. To insert and retain members 25 in the desired pattern inside chamber 20, aligning means are provided to set each member 25 in a predetermined position with respect to the other members 25 and to flow direction 23, and circumferential connecting members are provided for connecting members 25 circumferentially to chamber 20.

In the example shown, each member 25 has a groove 31 formed in a predetermined position on a peripheral edge 32 of respective plate 27; a longitudinal guide 33 parallel to axis L is provided inside chamber 20 to engage grooves 31; and members 25 are separated by substantially ring-shaped spacers 35 stacked alternately with members 25 and having respective grooves 36 cooperating with guide 33.

In the FIG. 1 embodiment, members 25 are equally spaced along axis L, and plates 27 are all the same thickness. It is understood, however, that both the spacing of members 25 and the thickness of plates 27 may vary in flow direction 23.

Preferably, though not necessarily, holes 26 of each member 25 are all of the same diameter. The holes 26 of consecutive members 25, however, may differ in diameter, and preferably get smaller in diameter in flow direction 23 inside chamber 20. Holes 26 of each member 25 may also be arranged randomly, as opposed to regularly as described above, providing the randomly arranged holes 26 of consecutive members 25 are offset.

Figure 4:
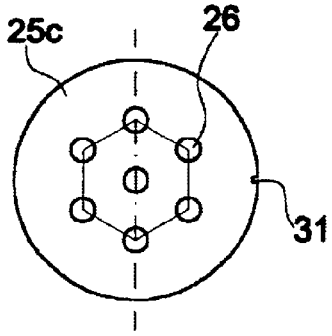
FIG. 4 shows a plan view of an optional component part of the FIG. 1 device.

FIG. 4 shows an optional member 25*c*, which may, for example, be used as the first member in the succession of members 25, and which has through holes 26 larger in diameter than holes 26 of succeeding members 25, spaced in the form of a hexagon, and centrally symmetric about axis L.

Figure 5:
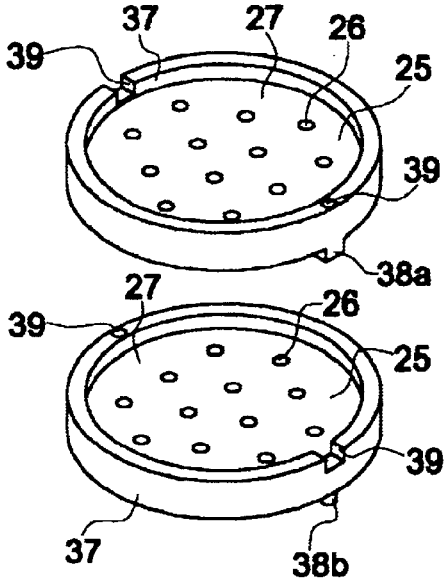
FIG. 5 shows an exploded view in perspective of an alternative embodiment of the FIG. 2 component parts.

In the FIG. 5 variation, members 25 again comprise respective substantially flat, circular, perforated plates 27, but spacers 35 are carried integrally in one piece with plates 27, and are defined by respective projecting peripheral collars 37 of members 25. Collars 37 project axially on both sides of respective plates 27, but may obviously also project from one side only. Each collar 37 has two diametrically opposite axial projections 38 of different cross sections (e.g. a substantially rectangular-section projection 38*a*, and a substantially circular-section projection 38*b*); and two seats 39, each of the same shape as a corresponding projection 38. Projections 38 of each member 25 are inserted inside seats 39 on the succeeding member to align members 25 with respect to one another and connect each member 25 circumferentially to the succeeding member.

In actual use, when valve assembly 3, controlled by float 15, is opened, as known, to fill the tank, water flows into chamber 20 through inlet 21, and down through chamber 20 substantially in flow direction 23. Before flowing out through outlet 22, the water flows down chamber 20 through holes 26, and therefore along the labyrinth path (i.e. a number of winding coil-like or zigzag paths) defined by members 25, thus significantly reducing the noise level when filling the tank, as confirmed by tests.

Clearly, changes may be made to the device as described and illustrated herein without, however, departing from the scope of the present invention.

In particular, the water inside chamber 20 may be circulated upwards, as opposed to downwards as described above. Also, chamber 20 may be located upstream, as opposed to downstream, from valve assembly 3, as illustrated for example in EP-A-42427, so that chamber 20 and members 25 also dampen the vibration induced by the transient state when closing valve assembly 3, thus further reducing the overall noise level. To improve flow through chamber 20 and the noise-reducing performance of members 25, changes may be made to the spacing of members 25, the arrangement, shape and/or size of holes 26, and the thickness of plates 27.

What is claimed is:

1. A silent-operating device for feeding water into a tank, in particular for filling a lavatory flush tank, comprising a chamber for the passage of a flow of water and housing flow deflecting members; an inlet and an outlet defining a flow direction; and connecting members adapted to circumferentially lock said deflecting members to the chambers; wherein said deflecting members are perforated members arranged successively and spaced apart substantially in said flow direction.

2. A device as claimed in claim 1, characterized in that each of said deflecting members has at least one through hole; the holes of consecutive members being offset with respect to one another to define, inside the chamber, a winding coil-like or zigzag path for said flow.

3. A device as claimed in claim 1, characterized in that said deflecting members have respective numbers of through holes; the holes of consecutive members being offset with respect to one another to define, inside the chamber, a labyrinth path for said flow.

4. A device as claimed in claim 1, characterized in that said deflecting members are positioned transversely inside the chamber, and are arranged successively and spaced apart substantially along the longitudinal axis of the chamber.

5. A device as claimed in claim 1, characterized in that said deflecting members are separated by spacers.

6. A device as claimed in claim 5, characterized in that said spacers are substantially ring-shaped and stacked alternately with said deflecting members.

7. A device as claimed in claim 1, characterized by comprising aligning means for aligning said deflecting members, and for setting each of said members in a position with respect to the other members and with respect to said flow direction.

8. A device as claimed in claim 1, characterized by comprising circumferential connections for connecting each of said deflecting members circumferentially to a consecutive member or to said chamber.

9. A device as claimed in claim 1, characterized in that each of said deflecting members has at least one axial projection which engages a corresponding seat formed in the consecutive member.

10. A device as claimed in claim 1, characterized by comprising a guide extending longitudinally inside said chamber and cooperating with said members.

11. A device as claimed in claim 1, characterized in that said deflecting members comprise respective substantially flat, perforated plates, and respective projecting peripheral collars; each of said collars resting axially on the collar of a consecutive member to separate said plates.

12. A device as claimed in claim 11, characterized in that said plates are positioned substantially perpendicular to a longitudinal axis of the chamber, and have respective numbers of through holes substantially parallel to said axis.

13. A silent-operating device for feeding water into a tank, in particular for filling a lavatory flush tank, comprising:

a chamber for the passage of a flow of water and housing flow deflecting members;

an inlet and an outlet defining a flow direction; wherein said members are perforated members arranged successively and spaced apart substantially in said flow direction, and the perforated members are separated by ring-shaped spacers which have a thickness substantially the same as the depth of the holes in the perforated members.

14. A silent-operating device for feeding water into a tank, in particular for filling a lavatory flush tank, comprising:

a chamber for the passage of a flow of water and housing flow deflecting members;

an inlet and an outlet defining a flow direction; wherein said members are perforated members arranged successively and spaced apart substantially in said flow direction, and said members further including a number of holes spaced in the form of a triangle which are symmetric with respect to the geometric centre of the member.

15. The device of claim 14, wherein the holes define a labyrinth path for said flow.

16. The device of claim 14, wherein the holes of consecutive members being offset with respect to one another to define, inside the chamber, a winding coil-like or zigzag path for said flow.

17. The device of claim 14, wherein consecutive perforated members are turned 180° with respect to each other.

18. A silent-operating device for feeding water into a tank, in particular for filling a lavatory flush tank, comprising:

a body housing a valve assembly interposed between an inlet and an outlet channel;

a substantially vertical outflow pipe connected to the outlet channel; wherein the valve assembly further comprises a diaphragm which separates the inlet channel from the outlet channel and encloses a counterpressure chamber provided with perforated members housed inside the outflow pipe.

19. The device of claim 18, wherein the diaphragm is a disc-shaped elastically deformable diaphragm.

20. The device of claim 1, wherein the connecting members are circumferentially connecting members.

21. The device of claim 1, the connecting members further comprising, a longitudinal guide adapted to engage grooves formed on edges of the perforated members.

* * * * *